US007040528B2

(12) United States Patent
Hengami

(10) Patent No.: US 7,040,528 B2
(45) Date of Patent: May 9, 2006

(54) DISPENSER/CLOSURE FOR FLEXIBLE PRODUCT CONTAINERS

(76) Inventor: David Todjar Hengami, 4455 Torrance Blvd., #356, Torrance, CA (US) 90503

( * ) Notice: Subject to any disclaimer, the term of this patent is extended or adjusted under 35 U.S.C. 154(b) by 0 days.

(21) Appl. No.: 10/269,788

(22) Filed: Oct. 10, 2002

(65) Prior Publication Data

US 2003/0168501 A1 Sep. 11, 2003

Related U.S. Application Data

(60) Provisional application No. 60/363,722, filed on Mar. 11, 2002.

(51) Int. Cl.
*B65D 43/12* (2006.01)

(52) U.S. Cl. ..... 229/117.3; 222/505; 222/561; 229/125.12; 229/220; 383/59; 383/66; 383/906

(58) Field of Classification Search ..... 229/117.3, 229/211, 220, 125.05, 125.12, 129.1; 222/182, 222/505, 92, 105, 541.2, 541.6, 545, 561, 222/559; 383/58, 59, 66, 204, 906, 67; 55/367, 55/373

See application file for complete search history.

(56) References Cited

U.S. PATENT DOCUMENTS 2,431,744 A * 12/1947 Fessenden ..... 229/125.12
2,628,761 A * 2/1953 Yancey ..... 229/125.12
2,864,462 A * 12/1958 Brace ..... 55/367
3,040,953 A * 6/1962 Tindall ..... 229/220
3,887,124 A * 6/1975 Skau ..... 229/125.12
4,779,793 A * 10/1988 Runo et al. ..... 229/125.12
5,158,635 A * 10/1992 Schmierer et al. ..... 229/125.12
5,468,272 A * 11/1995 Schmierer ..... 55/367
5,505,373 A * 4/1996 von Stillfried ..... 229/129.1
5,725,620 A * 3/1998 Perea et al. ..... 55/367
6,116,499 A * 9/2000 Todjar-Hengami ..... 229/117.3
6,733,555 B1 * 5/2004 Wilder ..... 55/367

* cited by examiner

*Primary Examiner*—Gary E. Elkins
(74) *Attorney, Agent, or Firm*—Fulwider Patton LLP; Scott R. Hansen

(57) ABSTRACT

A dispenser adapter assembly for bags includes a bag having a line of weakness defining an opening, and a dispenser adapter mounted to the bag. The dispenser adapter is formed of a first main base portion having an opening and a second slider retention base portion having an opening, with the two base portions being folded together with the openings substantially aligned with the bag opening. In addition a slide actuator is mounted between the two portions of the base for movement between a closed position blocking the openings and an open position permitting product flow through all of the openings. Mating movable and fixed stops are also provided to limit outward movement of the slide actuator.

15 Claims, 6 Drawing Sheets

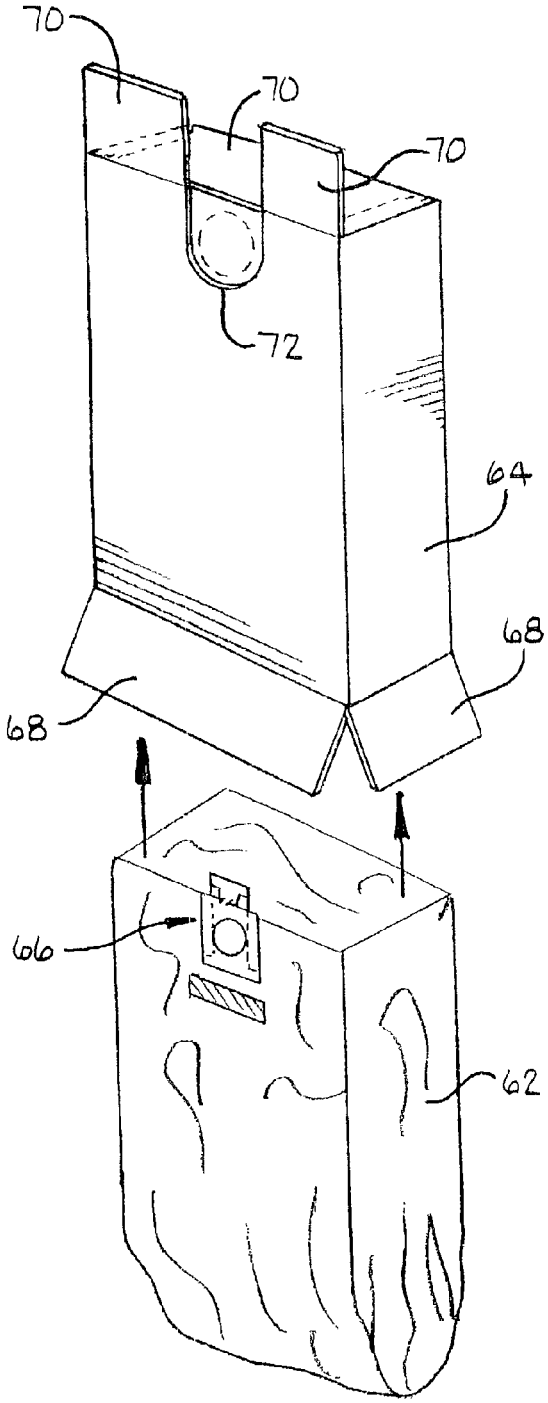
FIG. 9
FIG. 10
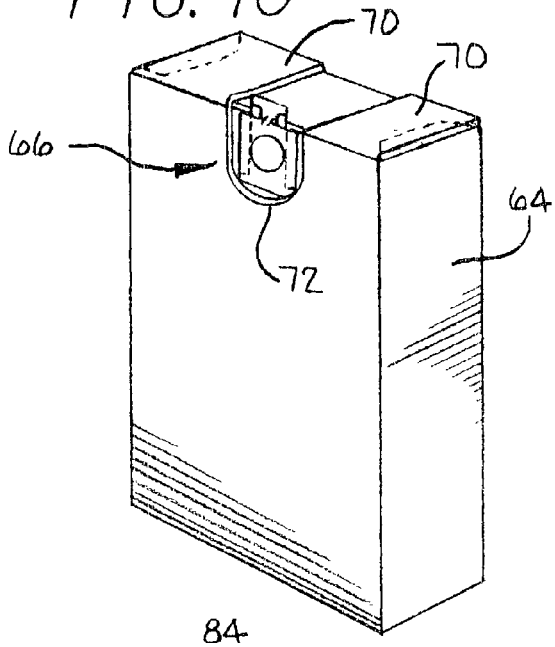
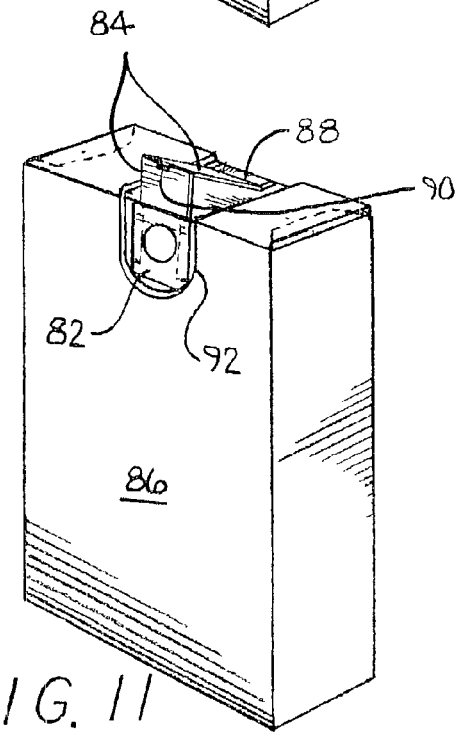
FIG. 11

DISPENSER/CLOSURE FOR FLEXIBLE PRODUCT CONTAINERS

This application claims the benefit of Provisional application Ser. No. 60/363,722, filed Mar. 11, 2002.

FIELD OF THE INVENTION

This invention relates to arrangements for permitting the dispensing of product from flexible product contains such as bags, and for providing a closure for the bag following dispensing of a part of the contents thereof.

BACKGROUND OF THE INVENTION

Many products, such as candy, dry cereal, and certain types of cookies and crackers are sold in flexible bags. Once the bags have been opened, however, the bags are often not easily re-closed, with attendant spilling of product, loss of freshness, contamination, and similar problems. One product which has been proposed to overcome this problem is disclosed in U.S. Pat. No. 6,273,332 B1. In this arrangement, a bag is secured within a box, with a line of weakness in the bag defining a bag opening aligned with an opening in the box. Further, the box opening may be selectively closed or opened to disperse product.

While this arrangement is satisfactory for products in bags mounted in boxes, such as a dry cereal, it is not applicable to products sold in bags without enclosing boxes, and requires special manufacturing arrangements to secure the bag within the box.

SUMMARY OF THE INVENTION

Accordingly, it is a principal object of the inventor to provide a simple dispenser/closure for products in flexible bags, which solve the problems outlined above.

In accordance with one specific illustrative embodiment of the invention, a dispenser adapter for flexible pourable product containers, such as bags, includes a flexible bag with lines of weakness defining a bag opening, preferably near one end of the bag, and a dispenser base having a first main base portion and a second slider retention portion, both with openings, and with the two portions being folded together to provide aligned dispenser openings and a guide. The dispenser base is mounted to the bag with the bag opening aligned with the dispenser openings. A slide actuator is mounted between the first and second portions of the base, and this slide actuator is movable between a closed position blocking the openings and closing the bag, and an open position permitting product to flow through the openings in the bag and base.

Other features or aspects of the dispenser adapter assembly may include the following:

1. The base and the slide actuator may have interfitting stops for limiting outward movement of the actuator.

2. The stops may involve outwardly extending movable stop tabs at the inner end of the actuator, and mating fixed stops on the base near the mouth of the base where the slide actuator exits the base.

3. A first portion of the base may have side flaps which may be folded over the second portion of the base to hold the two portions of the base together, and to provide a guide for the slide actuator.

4. The base may be secured to the bag with the second portion in engagement with the bag, whereby the smooth surface of the first portion of the dispenser/closure is exposed.

5. The bag and dispenser adapter assembly may be mounted in a box, with the box being cut away or having an opening to provide access to the slide actuator and to permit product flow.

6. The slide actuator may be provided with an extension for securing to the top of the box with the extension flat against the top of the box when the slide is closed, and angularly raised where the slide is opened.

7. The slide actuator has an extended portion for gripping by the user.

8. An easily broken line of weakness, preferably in the form of a tie or perforations may be provided between the slide actuator and the base, to hold the slider in place prior to initiating the dispensing mode of the unit. This easily broken line of weakness maybe be at either end of the slide actuator, or slider.

9. The fixed stops for the assembly may involve fold lines, folded material or adhesive stops, for example.

In accordance with a further aspect of the invention, a dispenser adapter for flexible pourable product containers, such as bags, includes a flexible bag with lines of weakness defining a bag opening, preferably near one end of the bag, and a dispenser base having at least one opening, and with a portion of the base being folded over to provide a dispenser opening aligned with the bag opening and a guide. A slide actuator is mounted on the base with movement limited by the guide, and this slide actuator is movable between a closed position blocking said openings and closing the bag, and an open position permitting product to flow through the openings in the bag and base.

Other objects, features and advantages of the invention will become apparent from a consideration of the following detailed description and from the accompanying drawings.

BRIEF DESCRIPTION OF THE DRAWINGS

FIG. 9 illustrates the application of the dispenser adapter to a bag and box assembly, in an exploded view;

FIG. 10 shows the assembled configuration of the parts shown in FIG. 9;

FIG. 11 shows an assembly with an extension provided for the slide actuator, and with the extension secured to the top of the box.

DETAILED DESCRIPTION OF THE PREFERRED EMBODIMENTS

Figure 1:
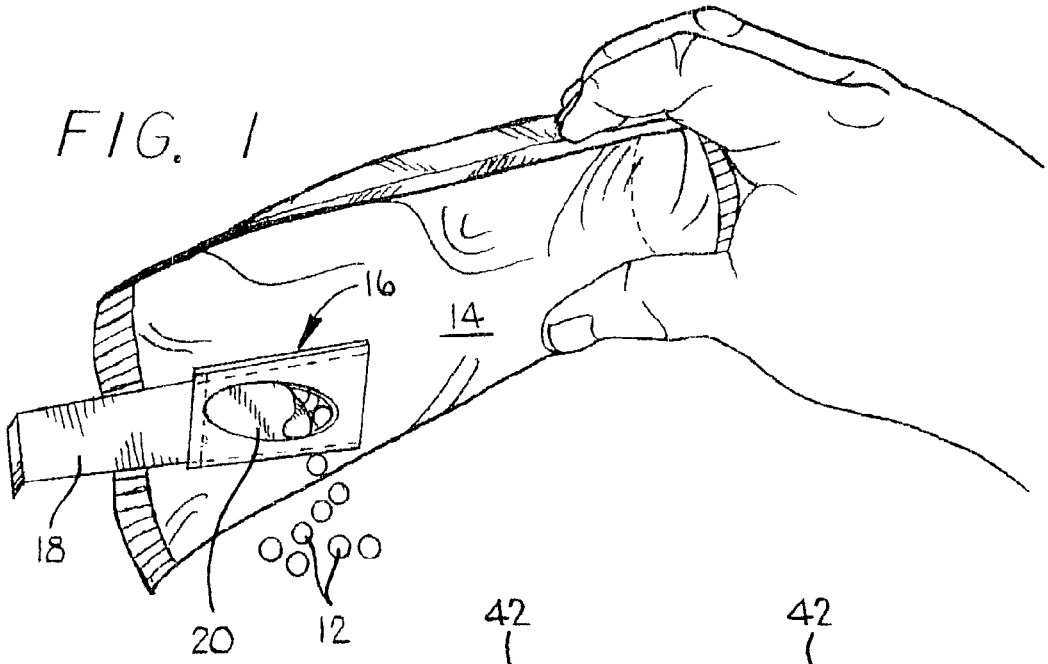
FIG. 1 is a schematic perspective view showing a dispenser adapter illustrating one embodiment of the invention in the open configuration for dispensing pourable product.

Referring now to FIG. 1 of the drawings, product 12 from a bag 14 is being dispensed from the bag 14 using the dispenser adapter 16 with the slide actuator 18 in its open position. As will be developed below, the slide actuator 18 may be slid into the dispenser adapter 16 to close the bag 14.

In FIG. 1, a portion 20 of the bag 14 is coming free from the bag 14 and may be removed to provide a hole aligned with the holes in the adapter. In the course of the manufacturing step, the material 20 of the bag is outlined by a line of weakness, which may take the form of a series of perforations, or by partially die cutting through the material of the bag. As another manufacturing step, the dispenser adapter assembly may be mounted to the film or sheet material from which the bag is formed prior to completion of the bag or filling it with product.

The next few figures of the drawing show steps in the formation of the dispenser adapter, such as that shown at reference number 16 in FIG. 1.

Figure 2:
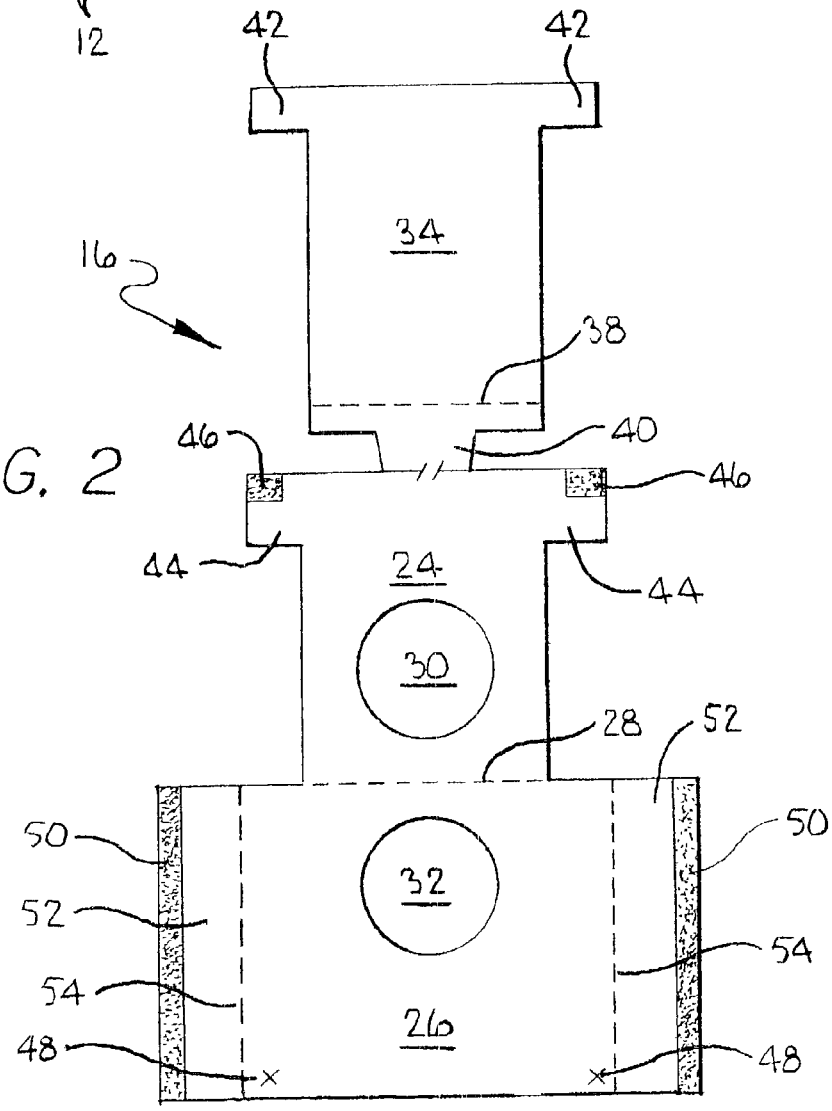
FIG. 2 shows a blank from which a dispenser adapter may be formed.

FIG. 2 shows a blank 16 from which the complete dispenser adapter may be formed. In FIG. 2 the base is formed of a first portion 24 and a second portion 26, separated by a fold line 28. The openings 30 and 32 are aligned where the two parts 24, 26 are folded along line 28.

The slide actuator 34 is secured to the base part 24 only by tie 36 so that it may be readily separated from base part 24 when the dispenser adapter is put into use. Fold line 38 extending across the slide actuator 34, may be noted, and permits easy gripping of the actuator tab 40 which is used to shift the position of the slide actuator 34.

The mating stops 42 on the slide actuator, and 44 on the base part 24 serve to limit outward movement of the slide actuator 34 as more clearly shown in later figures of the drawings.

The spots of adhesive 46 on base part 24 engage areas 48 on base part 26 to firmly secure stop tabs 44 in place. The adhesive stripes 50 at the outer edges of base part 26 hold base parts 24 and 26 together, following folding along line 28, and subsequent overlapping folding of the side flaps 52 inward along fold lines 54.

Figure 3:
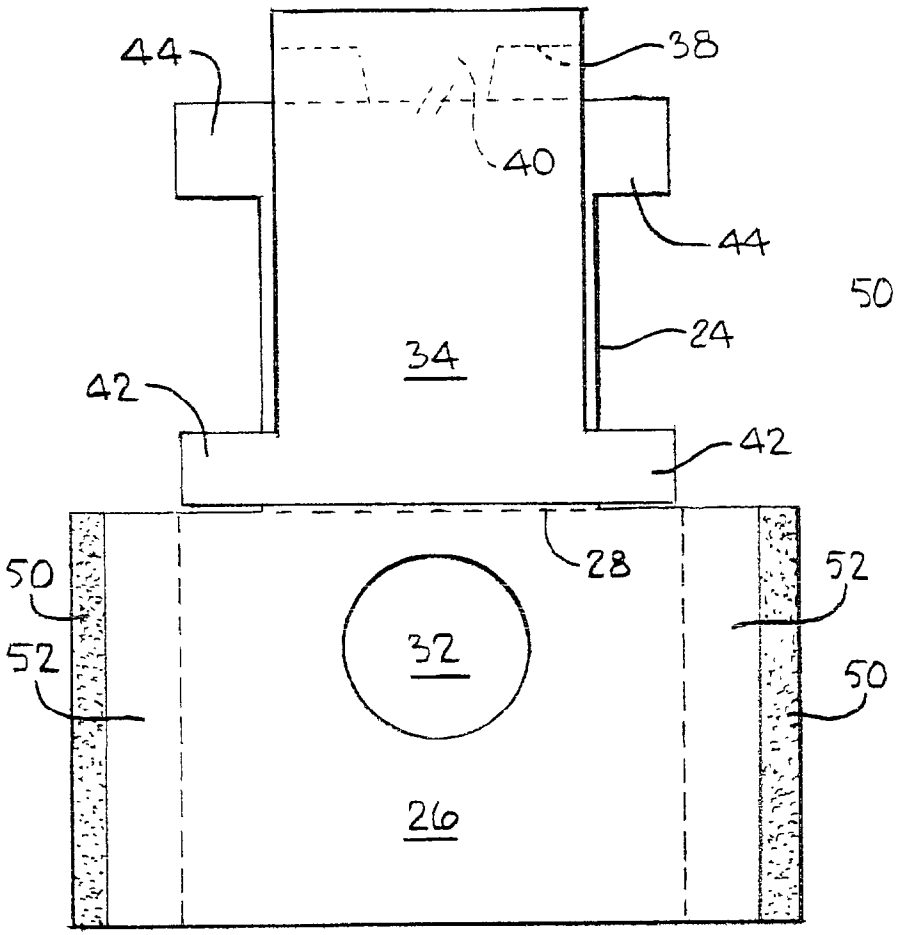
FIG. 3 shows an initial step of folding the slide actuator down, in the course of forming the completed assembly.

FIG. 3 of the drawings shows the first step in the formation of the blank of FIG. 2 into the completed dispenser adapter. More specifically, in FIG. 3 the slide actuator 34 has been folded down along line 38, with the remainder of the assembly being as shown in FIG. 2. It may also be noted that, in the showing of FIG. 3, the actuator tab 40 has been bent back, so that it is only shown in dashed lines.

Figure 4:
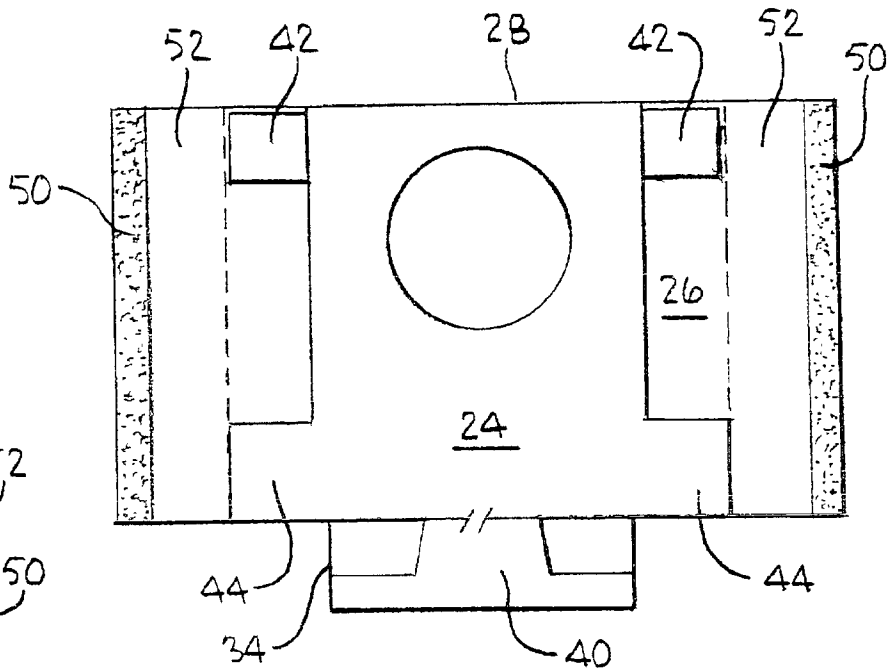
FIG. 4 shows the second step of folding the slide actuator and one part of the base over the other portion of the base.

In FIG. 4 of the drawings the upper portion of the partial assembly of FIG. 3 has been folded down along fold line 28, so that the slide actuator 34 is between the base parts 24 and 26. In addition, the mating stops 42 on the slide actuator and 44 on part 24 may been seen in their operating relationships. In the showing of FIG. 4, the side flaps 52 have not yet been folded over to complete the assembly.

Figure 6:
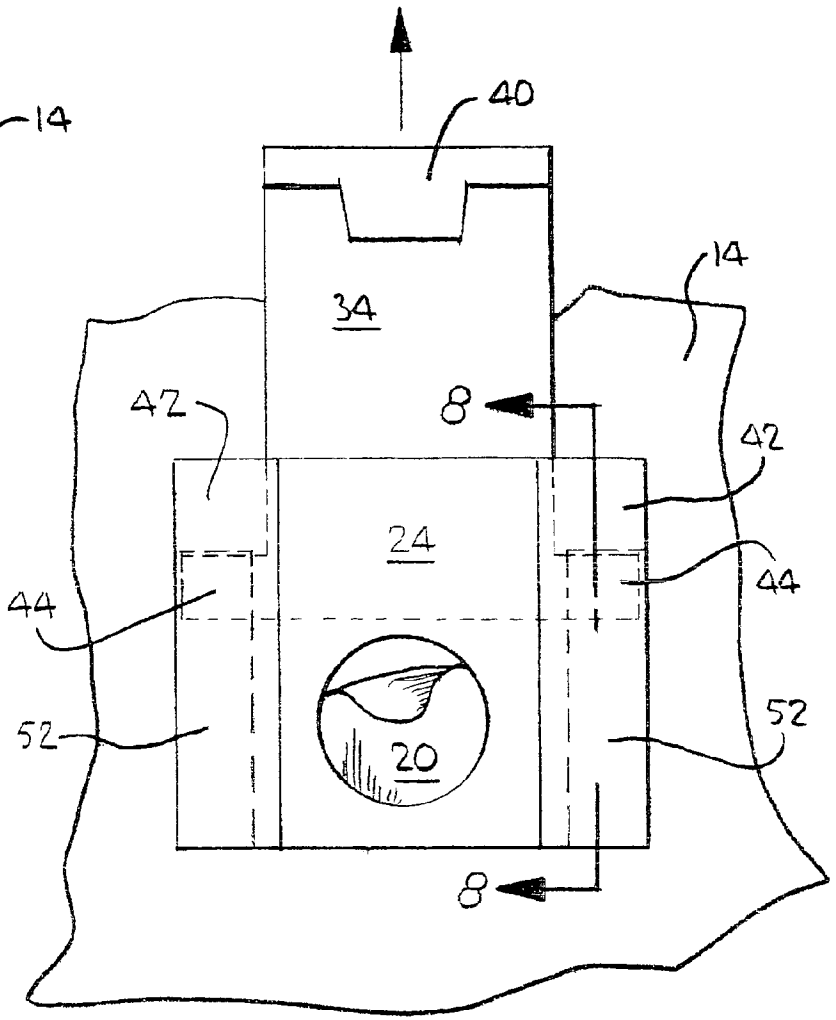
FIG. 6 is a view similar to that of FIG. 5, but with the slide actuator open.
Figure 5:
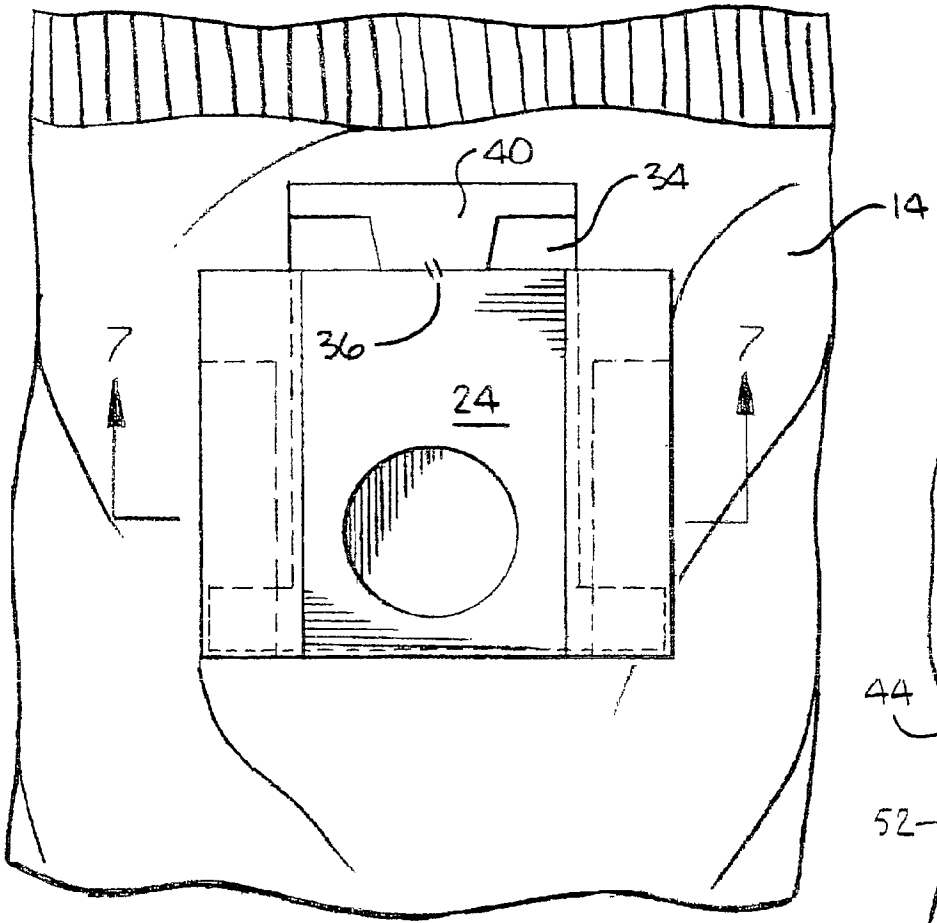
FIG. 5 shows the assembled adapter mounted on a bag, with the slide actuator closed.

FIGS. 5 and 6 show the dispenser adapter 16 mounted on a bag 14, with FIG. 5 showing the slide actuator 34 in the closed position, and FIG. 6 showing the slide actuator 34 in the open position.

In FIG. 5 the slider 34 and the tab 40 are still secured to the base part 24 by the tie 36. This tie 36 is merely a very short connection between two cuts so that it is easily broken to operate the slide actuator and open the dispenser adapter, as shown in FIG. 6. Incidentally, instead of the single tie 36, perforations, or several ties, or merely a line of weakness by partially die cutting along the line, including tie 36, may be employed.

FIG. 6 shows the stops 42 on the slide actuator engaging the stops 44 on the base portion 24 to limit outward movement of the slide actuator 34.

In both FIGS. 5 and 6, the side flaps 52 on base part 26 have been folded over and adhesively secured to base part 24. The slide actuator 34 is now constrained to linear in-and-out motion as the stops 42 engage the resultant fold, and the reduced width upper part of the slide actuator 34 is limited in its lateral movement by stops 44.

Figure 7:
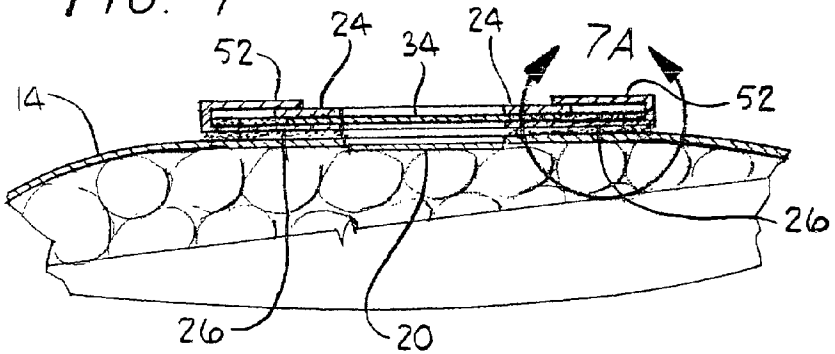
FIG. 7 is a cross-section taken along line 7—7 of FIG. 5.
Figure 7A:
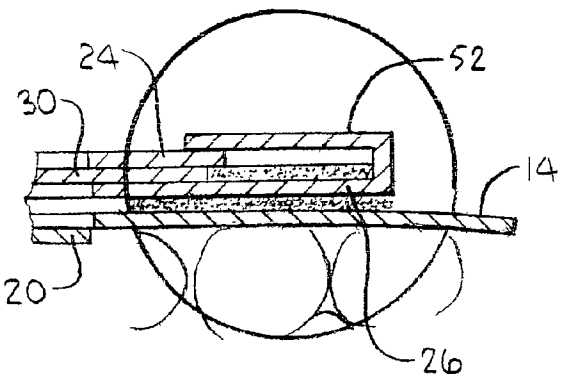
FIG. 7A is an enlarged view of a portion of the cross sectional view of FIG. 7.

FIG. 7 is a cross-sectional view taken along line 7—7 of FIG. 5, and FIG. 7A is an enlarged view of a part of FIG. 7. Relative to FIGS. 7 and 7A, it may be noted that the slider 34 is closed and that the bag element 20 is shown partially loosened from bag 14. In addition, to be noted in FIGS. 7 and 7A are the side flaps 52 which hold the lower base part 26 to the upper base part 24.

Figure 8:
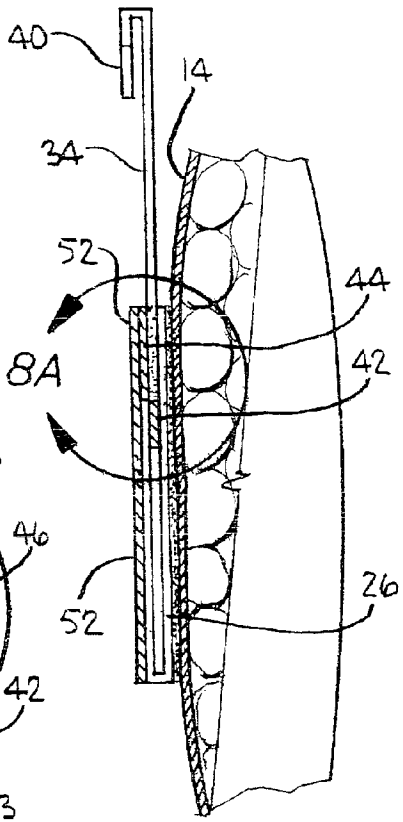
FIG. 8 is a cross sectional view taken along line 8—8 of FIG. 6.
Figure 8A:
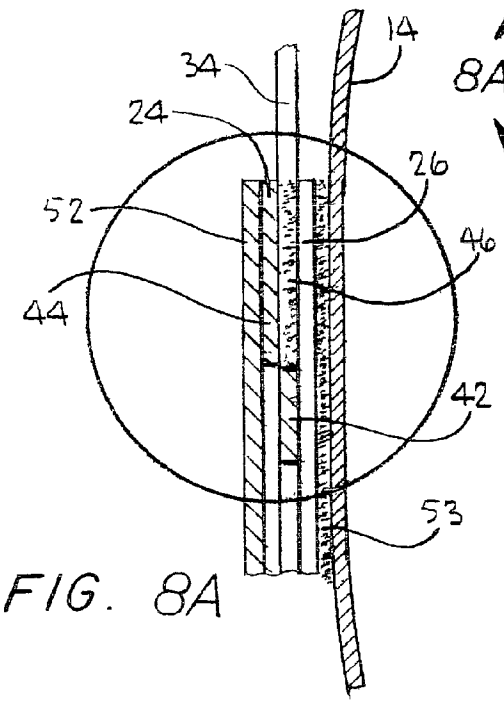
FIG. 8A is an enlarged cross-sectional view of a part of FIG. 8.

Turning now to the cross-sectional views of FIG. 8 and 8A, note that the cross-section is taken along lines 8—8 of FIG. 6, which shows the slider 34 in the open configuration. In FIGS. 8 and 8A, the top layer is the side flap 52 which holds the upper base member 24 to the lower base member 26. The stops 42 at the lower end of slider 34 ride in the space between the two base members 24 and 26. The adhesive 46 would be thinner than shown in FIG. 8A, and holds the tabs 44 close to lower base member 26 so that the stop tabs 42 on the slider 34 limit the upward movement of the slider to the point where stop tabs 42 engage stops 44 on the upper base member 24. Adhesive 53 bonds the dispenser assembly to the bag 14.

FIGS. 9 and 10 of the drawings show another embodiment of the invention in which a bag 62 is mounted in a box 64. The bag 62 may be provided with a dispenser adapter assembly 66 of the type described hereinabove. The box 64 is a generally conventional tube type box with lower closure flaps 68, and upper closure flaps 70. The box has an opening, or is cut away at area 72 so that the dispenser adapter assembly 66 is accessible, as indicated in FIG. 10.

FIG. 11 shows a bag and box configuration which is similar to the showing of FIGS. 9 and 10. However, the embodiment of FIG. 11 includes a dispenser adapter 82 with an extended slide actuator 84 which is secured to the top of the box 86 at area 88 located on the side of the top of box 86 away from the side of box 86 where the main dispenser adapter assembly 82 is located. The slide actuator 84 may be provided with a tab or cut 90 to facilitate raising and lowering the slide actuator 84 and opening and closing the product package. As in the case of the arrangements of FIGS. 9 and 10, the box 86 may be cut away at area 92 to provide access to the dispenser adapter assembly 82.

Figure 12:
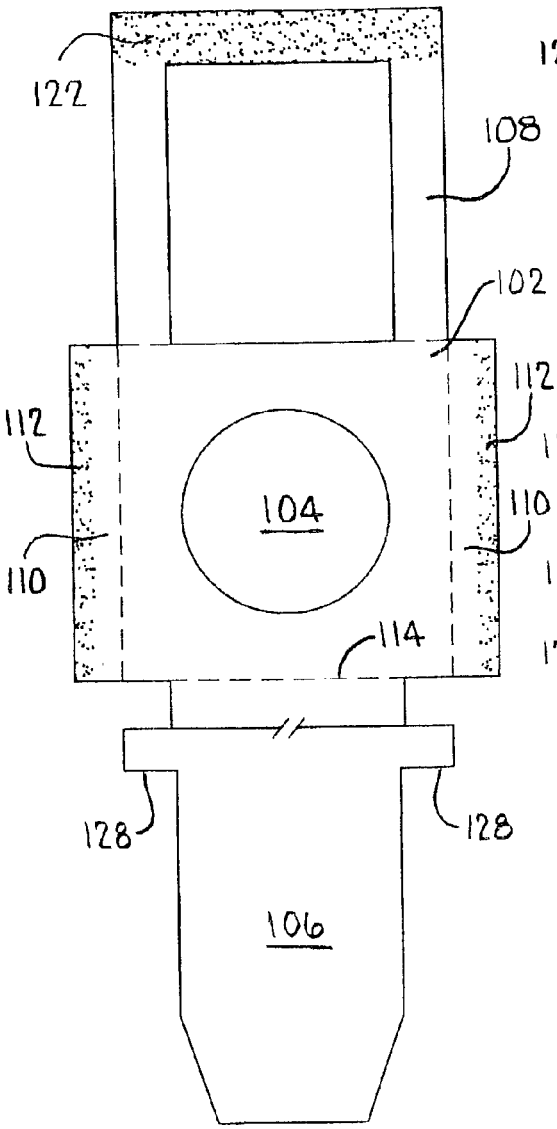
FIGS. 12, 13 and 14 show an additional embodiment of the invention, with FIG. 12 showing a blank, FIG. 13 showing partial formation, and FIG. 14 showing the completed dispenser adapter assembly.
Figure 13:
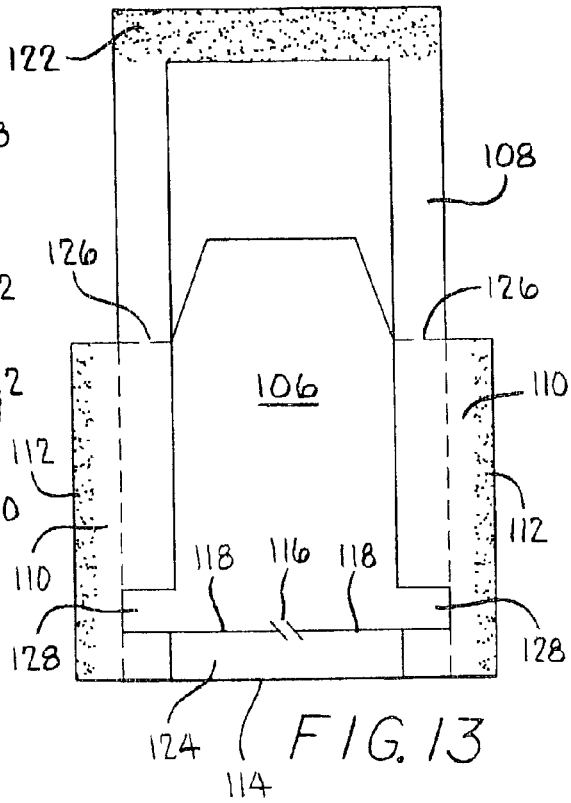
Figure 14:
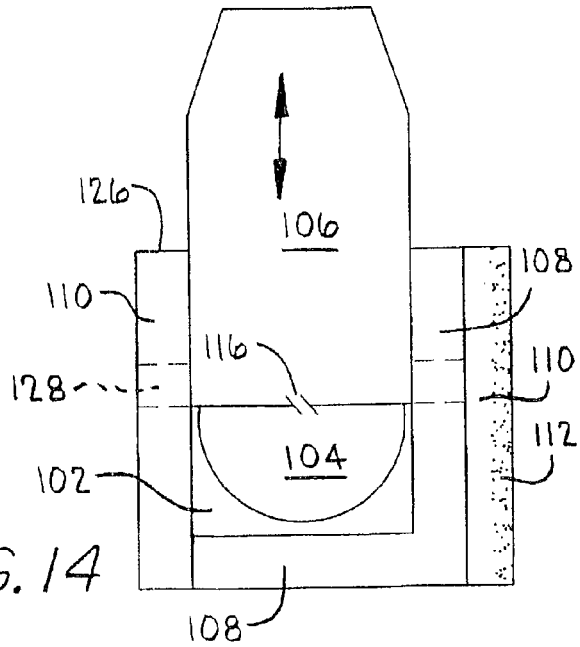

FIGS. 12, 13 and 14 show a further embodiment of the invention, with FIG. 12 showing a blank which may be folded and bonded to realize the invention, FIG. 13 showing a partially assembled configuration, and FIG. 14 showing the completed assembly.

FIG. 12 includes the main base portion 102 with a central opening 104 through which product may be dispensed. Also shown in FIG. 12 are the slide actuator or slider 106, and the slide retention member 108 which forms part of the fixed base portion of the assembly. The side flaps 110 on either side of the main base member 102, are provided with adhesive stripes 112 for subsequent bonding to the side portions of slide retention member 108.

In FIG. 13 the slider is shown folded inward along fold line 114. Incidentally the tie 116 indicates a line of weakness 118 along which the slider 106 may be separated from the remainder of the assembly. This line of weakness may be implemented by a single tie as indicated, or by perforations having long cuts and short ties, for example.

An adhesive coated area 122 of the slide retention member 108 is adhered to the area 124 by folding along the stop folds 12*b* to provide a positive fixed stop for engagement by the movable stops 128 on the slider 106.

FIG. 14 shows the assembled dispenser closer with the slider partially raised to partially open the hole 104 through which product may be dispensed. In FIG. 14 the left side flap 110 is shown closed, with the flap being adhesively secured to one of the side legs of the slide retainer 108; while the right hand side flap 110 has not yet been folded over the other side leg of slide retention member 108. In FIG. 14, the tie 116 has been broken, to permit opening of the slider 106.

One advantage of the embodiment of FIGS. 12–14 is that the fixed stop 126 for limiting movement of the slider is implemented by a fold in the material, rather than by adhesive, as in the case of the arrangements of FIGS. 1–11 of the present specification. It may also be noted that both the embodiment of FIGS. 12–14 and that of FIGS. 1–11 have a main base portion and a slider retention portion. Further, in the embodiment of FIGS. 12–14, the slider retention portion 108 has a central rectangular opening which is much larger than the opening 104 in the main base portion.

It is also noted that the dispenser adapter could, with minor changes, be made using only a slide actuator or slider similar to that shown as reference numeral 34 in FIG. 2, and a single base member such as that shown at reference numeral 26 in FIG. 2. To provide limiting stops for the slider, the upper ends of the flaps 52 may be cut and secured together; and the lower end of part 26 may be extended for adhesive bonding to the bag. Following adhesive binding of the adapter to the bag, the slider would be located between the hole in the bag and the hole in the single base member, when the slider is in its closed position; and product may be poured out of the bag when the side actuator or slider is shifted to its open position.

In conclusion, in the foregoing detailed description and in the accompanying drawings preferred embodiments of the invention have been disclosed. However, it is to be understood that various modifications and changes may be made without departing from the spirit and scope of the invention. Thus, by way of example and not of limitation, either side of the dispenser adapter may be secured to the bag or other container. Also, the upper ends of the flaps 52 could be cut to form the base stops 44, and the lower end of the slide actuator could be provided with a reversely bent tab to form a stop to mate with a similar reversely bent portion of a base member. In addition, the openings on the bag and the base members do not have to be of the same size or configuration; i.e., one or two of the holes or the base could be square or triangular if desired; or one of the base openings could merely be a frame extending around the hole in the other base member. Concerning materials, the dispenser adapter assembly may be made of heavy paper or light weight cardboard, of aluminum, of plastic sheet material, or any other sheet material, preferably compatible with the bag with which it is to be used. Regard the "tie" securing the slider to the base prior to use, any readily breakable coupling such as perforations or partial cutting to form a line of weakness, may be employed. Accordingly, the present invention is not limited to the precise embodiments as shown and described hereinabove.

What is claimed is:

1. A flexible bag dispenser adapter assembly comprising:
a flexible bag having a line of weakness on the bag defining a bag opening located toward one end of said flexible bag;
a dispenser base having a first main base portion with an opening and a second slide retention portion with an opening, said portions being folded together to provide aligned openings and a guide;
said base being mounted to said bag with said dispenser openings aligned with said bag opening;
and a slide actuator mounted between said first and second portions of said base, said slide actuator being movable between a closed position blocking said openings, and an open position permitting product flow though said openings in said bag and said base;
wherein the assembly further comprises a box containing said bag, said box being cut away to expose said openings, and the top of said box having an opening for receiving said extended portion of said actuator, whereby the contents of said box may be accessed by raising said actuator.

2. An assembly as defined in claim 1 wherein said box has first and second sides and a top, wherein said box is cut away on one side of said box, and wherein the end of the extended portion of said actuator is secured to the top of said box adjacent the second side of said box.

3. An assembly as defined in claim 1 further including side flaps for securing said first and second portions of said base together.

4. An assembly as defined in claim 1 wherein said dispenser base is mounted to said bag using permanent adhesive.

5. As assembly as defined in claim 1 wherein said slide actuator has first and second ends, with an actuator tab at the first end for gripping by the user, and outwardly extending stop tabs at the other end, said stop tabs engaging mating fixed stops on said base to limit movement of said actuator after said actuator reaches the open position.

6. The assembly as defined in claim 5 wherein said fixed stops constitute fold lines between said first and second portions of said base.

7. A flexible bag dispenser adapter assembly comprising:
a flexible bag having a line of weakness on the bag defining a bag opening located toward one end of said flexible bag;
a dispenser base having a first main base portion with an opening and a second slide retention portion with an opening, said portions being folded together to provide aligned openings and a guide;
said base being mounted to said bag with said dispenser openings aligned with said bag opening;
and a slide actuator mounted between said first and second portions of said base, said slide actuator being movable between a closed position blocking said openings, and an open position permitting product flow though said openings in said bag and said base;
wherein said first portion of said base has side flaps for folding over said second portion of said base for securing said first and second portions of said base together, and adhesive on said second portion of said base and on said side flaps for mounting said dispenser adapter to said bag.

8. A dispenser adapter assembly for use with containers, comprising:
a dispenser base having a first portion and a second portion folded together to provide aligned openings and a guide, said dispenser base having permanent adhesive thereon for securing said dispenser base to a container, said base having a front and rear portion; and a slide actuator mounted between said front and rear portions of said base, said slide actuator being movable between a closed position blocking said openings, and an open position permitting product flow though said openings in said adapter base;

wherein said slide actuator has first and second ends, with an actuator tab at the first end for gripping by the user, and outwardly extending stop tabs at the other end, said stop tabs engaging mating fixed stops on said base to limit movement of said actuator after said actuator reaches the open position, and wherein said fixed stops constitute fold lines between said first and second portions of said base.

9. An assembly as defined in claim 8 wherein said base and said actuator have interfitting stops for restraining movement of said actuator.

10. An assembly as defined in claim 8 wherein said actuator has an extended portion for gripping by the user.

11. An assembly as defined in claim 8, further including side flaps for securing said first and second portions of said base together.

12. As assembly as defined in claim 8, wherein said slide actuator has first and second ends, with an actuator tab at the first end for gripping by the user, and outwardly extending stop tabs at the other end, said stop tabs engaging mating tabs on said base to limit movement of said actuator after said actuator reaches the open position.

13. An assembly as defined in claim 8 wherein said slide actuator is initially secured to one of said base portions by breakable weakened material, whereby said slide actuator is held to said base prior to use, and is easily actuated by breaking said weakened material when the slider is shifted to the open configuration.

14. A dispenser adapter assembly for use with containers, comprising:

a dispenser adapter base having at least one opening and having parts thereof folded over to provide guiding arrangements;

a slide actuator mounted to said base and in engagement with said guiding arrangements;

said slide actuator being movable between a closed position blocking said opening, and an open position permitting product flow though said opening in said base;

said base and said slide actuator having mating stops for limiting movement of said slide actuator; and adhesive for securing said dispenser base to a container;

wherein said slide actuator has first and second ends, with an actuator tab at the first end for gripping by the user, and outwardly extending stop tabs at the other end, said stop tabs engaging mating fixed stops on said base to limit movement of said actuator after said actuator reaches the open position, and wherein said fixed stops constitute fold lines between said first and second portions of said base.

15. An assembly as defined in claim 14 wherein said slide actuator is initially secured to said base by breakable weakened material, whereby said slide actuator is held to said base prior to use, and is easily actuated by breaking said weakened material when the slider is shifted to the open configuration.

* * * * *